US009487325B2

(12) United States Patent
Scheidt

(10) Patent No.: US 9,487,325 B2
(45) Date of Patent: Nov. 8, 2016

(54) ARCHIVE BOX

(71) Applicant: Markus Scheidt, Oetinghausen (DE)

(72) Inventor: Markus Scheidt, Oetinghausen (DE)

( * ) Notice: Subject to any disclaimer, the term of this patent is extended or adjusted under 35 U.S.C. 154(b) by 0 days.

(21) Appl. No.: 14/428,914

(22) PCT Filed: Jun. 18, 2013

(86) PCT No.: PCT/EP2013/062617
§ 371 (c)(1),
(2) Date: Mar. 17, 2015

(87) PCT Pub. No.: WO2014/044424
PCT Pub. Date: Mar. 27, 2014

(65) Prior Publication Data

US 2015/0232225 A1 Aug. 20, 2015

(30) Foreign Application Priority Data

Sep. 20, 2012 (DE) ..... 20 2012 103 612 U

(51) Int. Cl.
*B65D 85/84* (2006.01)
*B65D 6/00* (2006.01)
*B65D 43/02* (2006.01)
*B65D 81/28* (2006.01)

(52) U.S. Cl.
CPC ..... *B65D 11/10* (2013.01); *B65D 43/02* (2013.01); *B65D 81/28* (2013.01); *Y10T 428/1376* (2015.01)

(58) Field of Classification Search
CPC ..... B65D 11/00; B65D 43/02; B65D 81/28
USPC ..... 206/524.6; 229/117.18, 167, 170, 186, 229/193, 198.2, 916, 918
See application file for complete search history.

(56) References Cited

U.S. PATENT DOCUMENTS

| | | | | | |
|---|---|---|---|---|---|
| 1,407,688 | A * | 2/1922 | Banton | B65D 5/4295 | 206/526 |
| 2,222,572 | A * | 11/1940 | Reger | E04B 1/7612 | 105/423 |
| 2,330,294 | A * | 9/1943 | Leavitt | B65D 5/566 | 229/122.32 |
| 3,341,102 | A * | 9/1967 | Stephens | B65D 81/30 | 174/385 |
| 4,507,348 | A * | 3/1985 | Nagata | B32B 3/28 | 108/57.25 |
| 5,772,029 | A * | 6/1998 | Boccacci | B42F 7/145 | 206/425 |
| 6,102,279 | A * | 8/2000 | Dowd | B65D 5/10 | 229/117 |
| 6,437,022 | B1 * | 8/2002 | Yoshihara | A45C 11/18 | 523/128 |
| 8,079,470 | B2 * | 12/2011 | Trajkovich | B32B 27/36 | 156/290 |
| 8,579,109 | B2 * | 11/2013 | Kim | B65D 85/18 | 2/145 |
| 8,771,770 | B1 * | 7/2014 | Crump | B65D 81/268 | 206/204 |
| 8,864,017 | B2 * | 10/2014 | McMahon | B65D 5/4266 | 229/198.2 |
| 8,883,295 | B2 * | 11/2014 | Lee | B32B 27/12 | 428/212 |
| 2006/0172048 | A1 * | 8/2006 | Etchells | A23B 4/16 | 426/326 |
| 2009/0045095 | A1 * | 2/2009 | Wagner | A23B 7/157 | 206/524.4 |
| 2010/0076901 | A1 * | 3/2010 | Bosher | B65D 77/0433 | 705/332 |
| 2014/0251858 | A1 * | 9/2014 | Cardona Jimanez | B65D 81/263 | 206/524.6 |

FOREIGN PATENT DOCUMENTS

| | | |
|---|---|---|
| DE | 3245196 A1 | 6/1984 |
| DE | 202011107984 U1 | 6/2012 |
| EP | 0662395 A1 | 1/1995 |

(Continued)

*Primary Examiner* — Nathan J Newhouse
*Assistant Examiner* — Jennifer N Zettl
(74) *Attorney, Agent, or Firm* — Richard M. Goldberg

(57) ABSTRACT

An archive box, in which the walls (16, 18, 22, 24) of the archive box are formed of micro-perforated plastics.

8 Claims, 2 Drawing Sheets

(56) References Cited

FOREIGN PATENT DOCUMENTS

| | | | |
|---|---|---|---|
| EP | 0846633 | A1 | 6/1998 |
| EP | 1842781 | A1 | 10/2007 |
| GB | 2188307 | A | 9/1987 |
| GB | 2421928 | A | 7/2006 |
| JP | 08-207494 | A | 8/1996 |
| JP | 2002-362077 | A | 12/2002 |
| JP | 2008-155952 | A | 7/2008 |
| WO | 2005/097518 | A1 | 10/2005 |

* cited by examiner

ARCHIVE BOX

BACKGROUND OF THE INVENTION

The invention relates to an archive box.

The term archive box designates a storage container that serves for archiving, i.e. for a long-term storage, of objects, in particular documents.

In most countries the requirements that such an archive box has to fulfil are specified in pertinent standards such as the standard ISO 16245. In particular, the archive box must not contain any substances and must not have physical properties that could be detrimental to the objects to be archived. The wall material shall have a certain mechanical strength and durability, shall have an abrasion-proof and light-proof surface and shall be non-acidic (pH>7.5). Moreover, the material must have a certain resistivity to water.

Conventional archive boxes are typically configured as cuboid cardboard boxes with slip lid. A solid board with 1.5 mm thickness has been used as wall material. The adhesives must be free of plasticisers, and only corrosion-free wires or rivets may be used as fastening material.

SUMMARY OF THE INVENTION

It is an object of the invention to provide an archive box with improved physical and chemical properties.

In order to achieve this object, according to the invention, the walls of the archive box consist of micro-perforated plastics.

The use of plastics as wall material permits to achieve the physical and chemical properties, in particular non-acidity and water resistivity, in a particularly advantageous way.

The material is outstanding in having a high mechanical strength and abrasion resistance and accordingly a high durability. The micro-perforations of the walls permit to achieve an air interchange that is comparable to the air interchange of conventional archive boxes made of cardboard and may be optimized further simply by appropriate selection of the pore dimensions and pore density.

Useful details of the invention are indicated in the dependent claims.

In an advantageous embodiment the walls of the box are formed by chambered multi-wall plastic sheet, as it is used in a similar form—though without micro-perforation—also for other containers. Then, the micro-perforation is formed in the walls of the multi-wall sheet that extend at right angles to the webs that separate the chambers, and the perforation is formed by continuous pores having a diameter that is preferably not larger than 1.0 mm. A pore diameter of 0.2 mm is particularly preferred. The pores may for example be arranged in a square pattern, with an inter-pore distance in the order of magnitude of 3 to 5 mm.

A particularly suited plastic material is polypropylene that is preferably configured to be flame-retarding by means of suitable additives. Further additives, e.g. substances that contain silver ions, may be used to achieve antibacterial and fungicidal properties.

BRIEF DESCRIPTION OF THE DRAWINGS

An embodiment example will now be described in conjunction with the drawings, wherein:

FIG. 2 is an enlarged horizontal cross section of a corner of the archive box with a slip lid put on.

DETAILED DESCRIPTION

Figure 1:
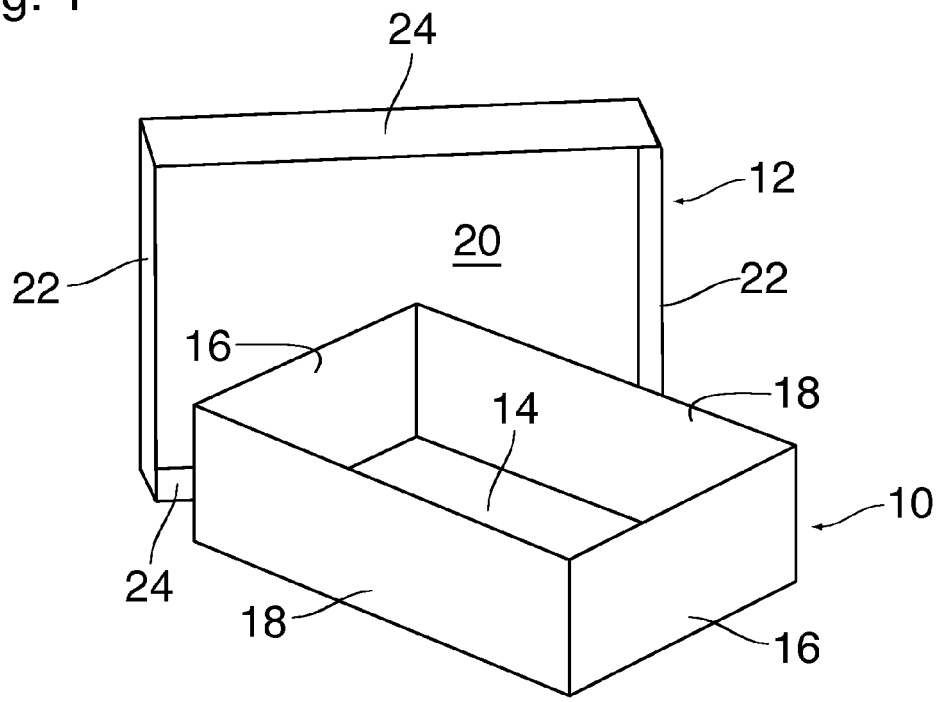
FIG. 1 is a perspective view of an archive box.

The archive box shown in FIG. 1 is a cuboid container 10 and has a slip lid 12 that is also cuboid and adapted to be put over the box with little play. The footprint of the container 10 is adapted to the dimensions of documents in the format DIN-A4 for example. The container has a bottom 14, short side walls 16 and long side walls 18. The bottom 14 and also the side walls 16 and 18 consist of micro-perforated plastics, e.g. polypropylene. The side walls 16 and 18 may be connected with the bottom 14 in one piece via folding lines, as it is generally known. At the vertical edges of the container the short and long side walls 16, 18 may be connected to one another by welding, for example, so that no adhesive nor other fastening materials such a wires or rivets are needed. For example, the side walls may be buttingly welded together at the edges of the container 10 so that, in contrast to cardboard boxes, no overlapping gluing straps are needed. Optionally, however, a certain overlap may be provided at the edges, as will be described in greater detail below.

The slip lid 12 also has a bottom 20, short side walls 22 and long side walls 24 and has—except for slightly different dimensions—the same construction as the container 10, so that it may be put over the container 10 with little play in order to close the latter.

Figure 2:
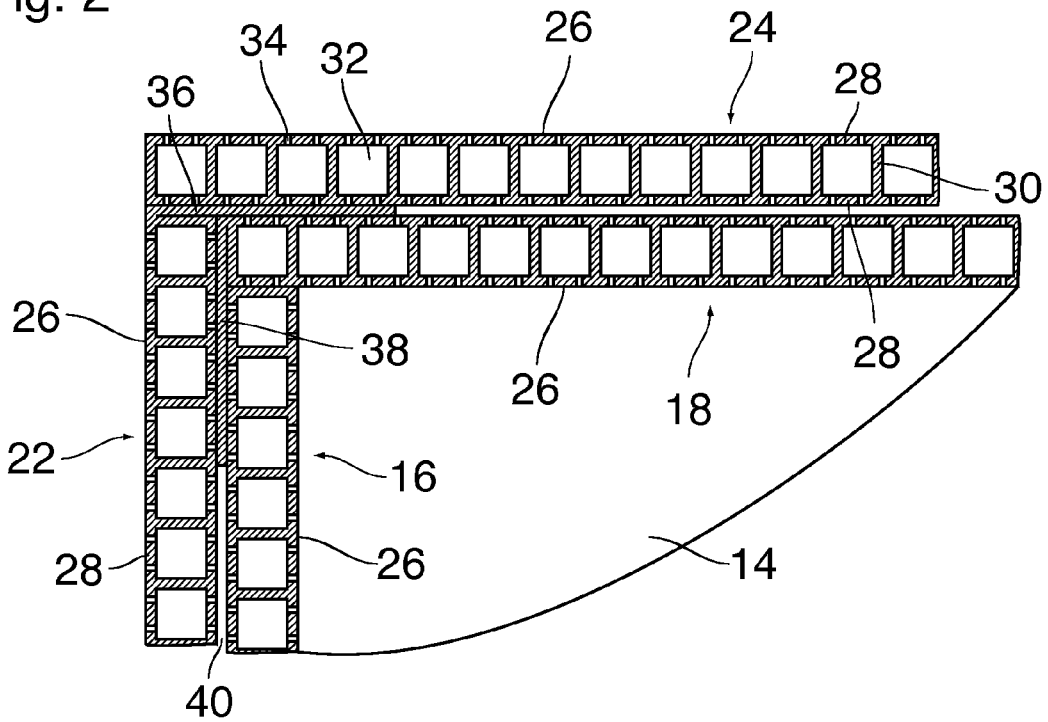
Figure 3:
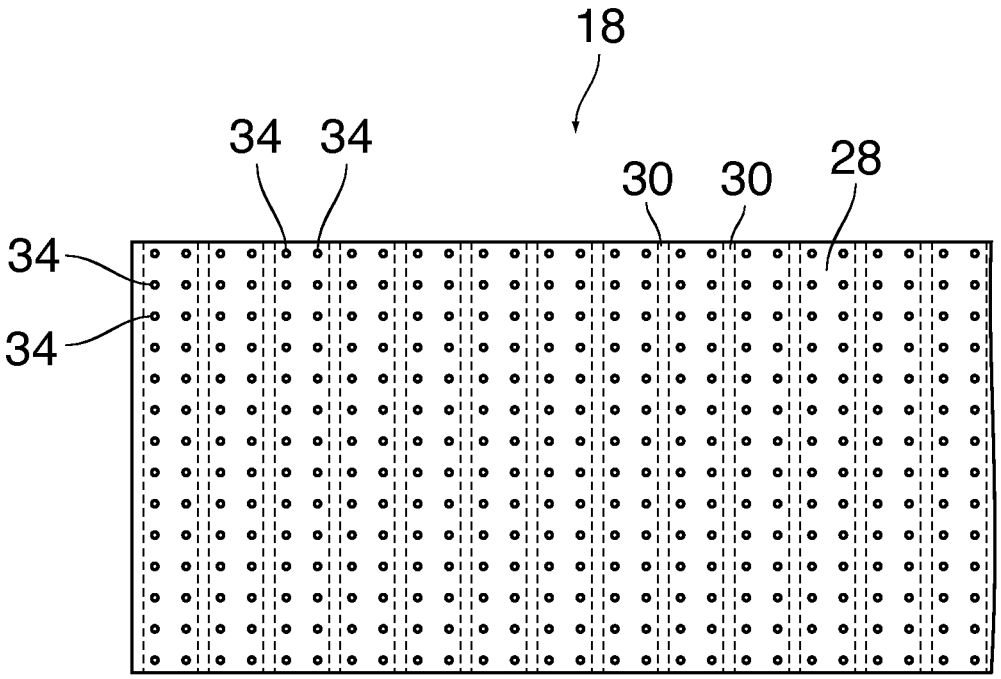
FIG. 3 is a view of a part of a wall of the archive box.

The bottoms 14, 20 and all side walls of the container 10 and the slip lid 12 are preferably configured as chambered multi-wall sheets 26 as shown in FIG. 2. Each of the chambered multi-wall sheets 26 has parallel walls 28 that form the internal and external surfaces of the container and the lid, respectively, and are interconnected by webs 30 that extend at right angles to the walls, preferably in vertical direction. Thus, hollow chambers 32 are delimited by the walls 28 and by two respective webs 30, and the chambers have a rectangular cross section, a square cross section in this example, with an edge length in the order of magnitude of 3 to 5 mm for example.

In the walls 28, micro-pores 34 are formed which are configured as continuous circular through-holes with a diameter of 0.2 mm in the example shown. As can be seen in FIG. 2, the micro-pores 34 are arranged in a square raster, with the pore-to-pore distance being selected such that each hollow chamber 32 includes two rows of micro-pores 34 and the micro-pores in the two parallel walls 28 of the chambered multi-wall sheet 26 are aligned with one another. This permits to achieve a certain air-permeability of the container 10 and the lid 12 and thus ensures that the objects to be archived are kept in an atmosphere that has a composition corresponding to that of the atmosphere in the archive room outside of the box.

In the example shown in FIG. 2, the external wall 28 of the short side wall 22 of the lid 12 is prolonged at both ends so as to form welding straps 36 which are folded over at an angle of 90° and engage the internal surface of the long side wall 24 of the lid. Correspondingly, the external wall 28 of the longer side wall 18 of the container 10 is prolonged to form a welding strap 38 that is folded over at right angles and engages the external surface of the short side wall 16 of the container. The welding straps 36, 38 permit to stably weld together the walls of the container and the lid, and at the same time they serve as spacers that ensure a certain gap between the container 10 and the lid 12 on all four sides.

This ensures an air interchange via the micro-pores 34 even when the micro-pores of the lid and those of the container are not aligned with one another.

The invention claimed is:

1. An archive box, comprising a cuboid container and a slip lid, each of the cuboid container and the slip lid including side walls and bottom walls, and all of the walls being formed of micro-perforated plastics, wherein the walls are formed by chambered multi-wall sheets and each multi-wall sheet has two parallel walls that are interconnected by webs and in which micro-pores are formed in both parallel walls of the multi-wall sheets, wherein at least one of the container and the slip lid includes an integral strap that provides a spacing between the walls of the container and the walls of the slip lid which ensures an air interchange via the micro-pores of the walls of the container and the slip lid even when the micro-pores of the container and the slip lid and are not aligned with one another.

2. The archive box according to claim 1, wherein the plastics is polypropylene.

3. The archive box according to claim 1, wherein the micro-pores are arranged in a regular raster and with inter-pore spacings such that a hollow chamber defined between the chambered multi-wall sheets and each web contains at least one row of micro-pores.

4. The archive box according to claim 1, wherein the micro-pores of the two parallel walls of the chambered multi-wall sheets are aligned with one another.

5. The archive box according to claim 1, wherein the micro-pores have a diameter of not more of 1 mm.

6. The archive box according to claim 1, wherein the walls made of the micro-perforated plastics are treated to be flame-retarding.

7. The archive box according to claim 1, wherein the plastics of the walls includes at least one of:

antibacterial additives and fungicidal additives.

8. The archive box according to claim 5 wherein the micro-pores have a diameter of not more of 0.3 mm.

* * * * *